US007134854B2

(12) United States Patent
Wu et al.

(10) Patent No.: US 7,134,854 B2
(45) Date of Patent: Nov. 14, 2006

(54) OIL RECYCLING APPARATUS FOR COMPRESSOR

(75) Inventors: San-Ming Wu, Sijhih (TW); Guang-Der Tarng, Sijhih (TW); Huei-Yuan Peng, Sijhih (TW); Chung-Hung Yeh, Sijhih (TW)

(73) Assignee: Chyn Tec. International Co. Ltd., Taipei (TW)

( * ) Notice: Subject to any disclaimer, the term of this patent is extended or adjusted under 35 U.S.C. 154(b) by 33 days.

(21) Appl. No.: 11/102,811

(22) Filed: Apr. 11, 2005

(65) Prior Publication Data

US 2006/0057011 A1 Mar. 16, 2006

(30) Foreign Application Priority Data

Sep. 14, 2004 (TW) ..... 93214638 U

(51) Int. Cl.
*F04C 18/00* (2006.01)
*F04C 2/00* (2006.01)
*F03C 2/00* (2006.01)

(52) U.S. Cl. ..... 418/55.6; 418/55.1; 418/97; 418/270; 418/DIG. 1; 184/6.18

(58) Field of Classification Search ..... 418/55.1–55.6, 418/57, 97, 270, DIG. 1; 184/6.18
See application file for complete search history.

(56) References Cited

U.S. PATENT DOCUMENTS 4,592,703 A * 6/1986 Inaba et al. ..... 418/55.6
5,007,809 A * 4/1991 Kimura et al. ..... 418/55.1
5,533,875 A * 7/1996 Crum et al. ..... 418/55.6
6,000,917 A * 12/1999 Smerud et al. ..... 417/368
6,474,964 B1 * 11/2002 De Bernardi et al. ..... 418/55.6

* cited by examiner

*Primary Examiner*—Theresa Trieu

(57) ABSTRACT

An oil recycling apparatus for compressor includes an oil baffle plate around a scroll unit of the compressor. A working gas flowed back to the scroll unit will impinge the oil baffle plate and is condensed. The condensed oil gas is attached to the oil baffle plate and flows back to an oil tank along the oil baffle plate.

3 Claims, 3 Drawing Sheets

OIL RECYCLING APPARATUS FOR COMPRESSOR

BACKGROUND OF THE INVENTION

1. Field of the Invention

The present invention relates to an oil recycling apparatus for compressor, and more particularly to an oil recycling apparatus used for scroll compressor and comprising an oil baffle plate.

2. Description of Prior Art

In the prior art scroll compressor, lubricating oil is generally applied among the movable components thereof to reduce the friction force among the movable components and to enhance performance of the scroll compressor. However, the vapor of the lubricating oil may be permeable into a high-pressure working gas of the scroll compressor. The lubricating oil is depleted and the performance of the scroll compressor is degraded.

SUMMARY OF THE INVENTION

The present invention provides an oil recycling apparatus used for scroll compressor and recycling lubricating oil gas carried by working gas.

Accordingly, the oil recycling apparatus for compressor according to the present invention includes an oil baffle plate around a scroll unit of the compressor. A working gas flowed back to the scroll unit will impinge the oil baffle plate and is condensed. The condensed oil gas is attached to the oil baffle plate and flows back to an oil tank along the oil baffle plate.

BRIEF DESCRIPTION OF DRAWING

The features of the invention believed to be novel are set forth with particularity in the appended claims. The invention itself however may be best understood by reference to the following detailed description of the invention, which describes certain exemplary embodiments of the invention, taken in conjunction with the accompanying drawings in which:

DETAILED DESCRIPTION OF THE INVENTION

Figure 1:
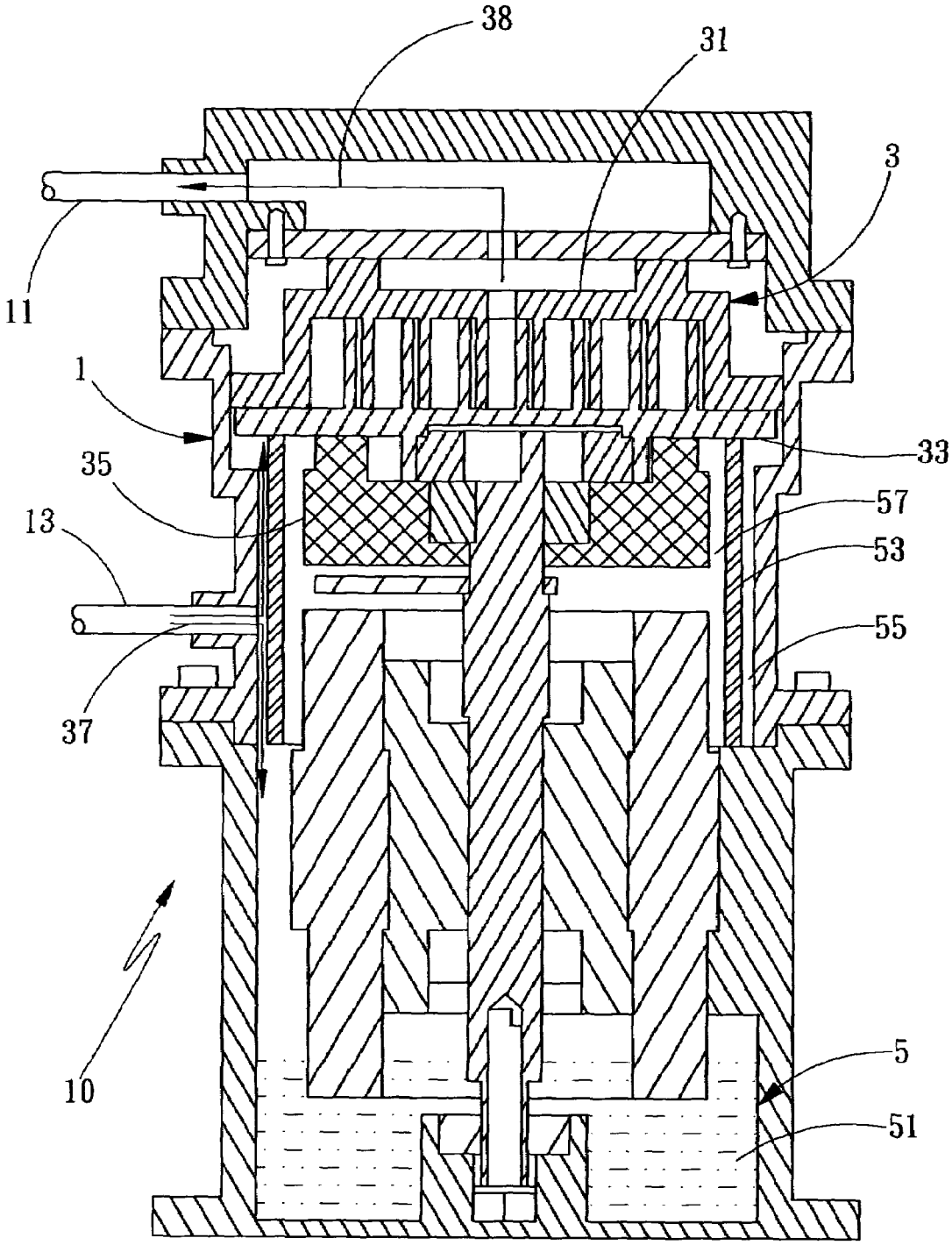
FIG. 1 shows a sectional view of an oil recycling apparatus for compressor according to a preferred embodiment of the present invention.

FIG. 1 shows a sectional view of an oil recycling apparatus for compressor according to a preferred embodiment of the present invention. The scroll compressor 10 comprises a closed casing 1, a scroll unit 3 and a lubricating unit 5.

The scroll unit 3 comprises a fixed scroll 31 and an orbital scroll 33 arranged on a supporting stage 35. A low-pressure gas 37 is flowed into the compressor 10 through a reflux tube 13 and compressed into a high-pressure gas 38. The high-pressure gas 38 can be sent, through a vent 11, to an external device requiring the high-pressure gas 38. The low-pressure gas 37 is flowed back to the compressor 10 through the reflux tube 13 from the external device.

The lubricating unit 5 is used to provide lubricating oil to the scroll compressor and comprises an oil tank 51 and an oil baffle plate 53. The oil tank 51 is placed below the scroll unit 3 and used for storing lubricating oil. The oil baffle plate 53 is a panel around the scroll unit 3. An outer passageway 55 is defined between the oil baffle plate 53 and the casing 1 and communicated with the oil tank 51. An inner passageway 57 is defined between the oil baffle plate 53 and the scroll unit 3 and communicated with the oil tank 51.

The reflux tube 13 is communicated with the casing 1 and guides the low-pressure gas 37 back to the scroll compressor 10. The oil baffle plate 53 will extend to a place where the reflux tube 13 is communicated with the casing 1 such that the low-pressure gas 37 flowed back from the reflux tube 13 will directly impinge the oil baffle plate 53.

The casing 1 is made by casting such that the scroll compressor 10 is formed into a semi-closed scroll compressor.

Figure 2:
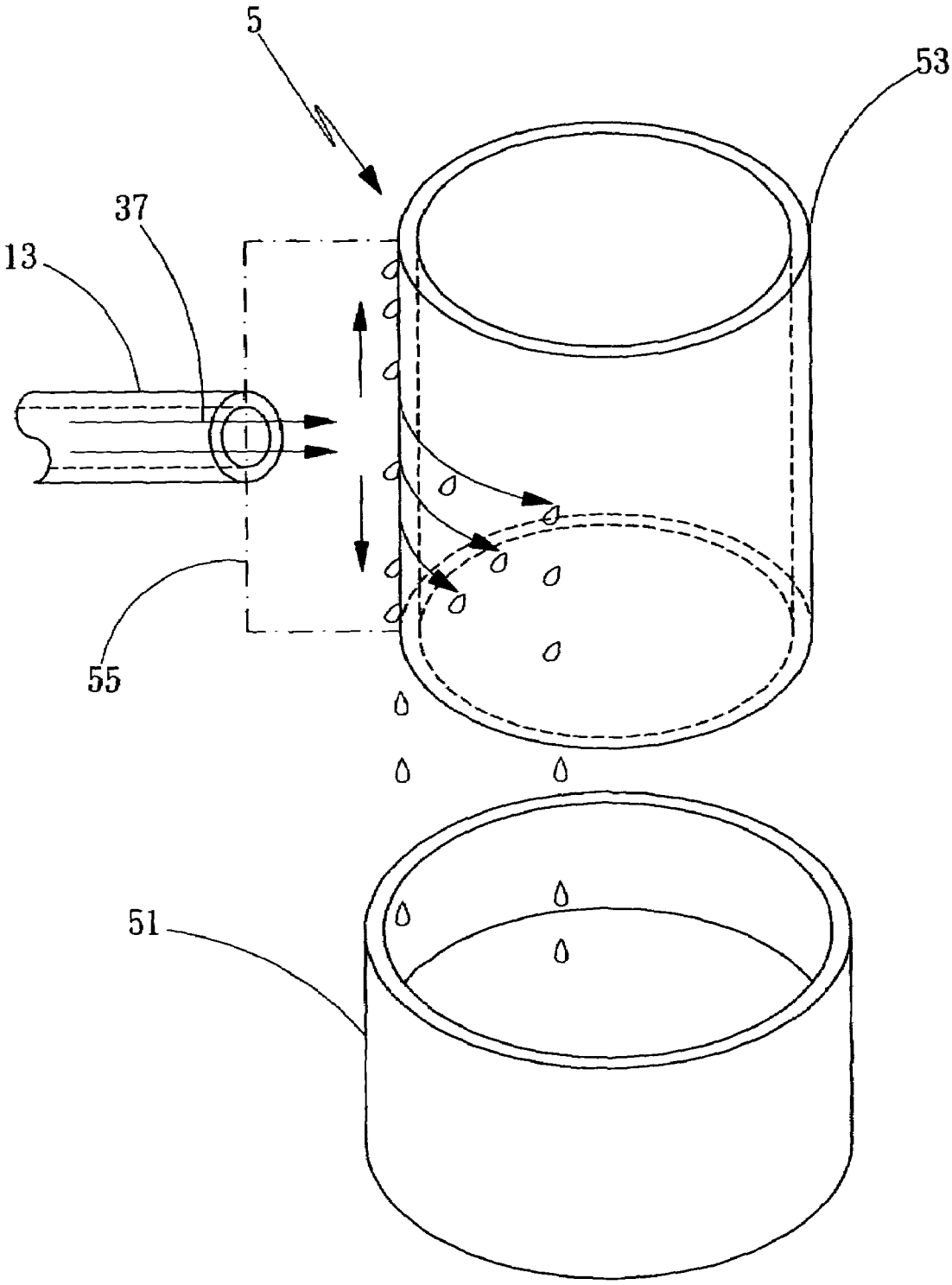
FIG. 2 is a perspective view showing partial components in an oil recycling apparatus for compressor according to a preferred embodiment of the present invention.

According to the oil recycling apparatus for compressor, the oil gas for compressor components will flow into the vent 11 together with the high-pressure gas 38 output from the scroll compressor 10. When the low-pressure gas 37 flows back to the scroll compressor 10 through the reflux tube 13, the low-pressure gas 37 will directly flow into the outer passageway 55 and impinges the oil baffle plate 53. As shown in FIG. 2, the oil gas in the low-pressure gas 37 will be attached to the oil baffle plate 53 and then flow back to the oil tank 51 along the oil baffle plate 53 and through the outer passageway 55 due to gravity thereof.

The fixed scroll 31, the orbital scroll 33 and the supporting stage 35 in the scroll unit 3 are components with relative movement. Therefore, lubricating oil supplied by the lubricating unit 5 is applied to those components. However, the oil gas may be scattered to the casing 1 of the scroll compressor 10. Therefore, the oil baffle plate 53 will extend to a lateral scattering position of oil gas in the scroll unit 3. The oil gas scattered to that position will be attached to the oil baffle plate 53 and then flow back to the oil tank 51 along the oil baffle plate 53 and through the inner passageway 57 due to gravity thereof.

Figure 3:
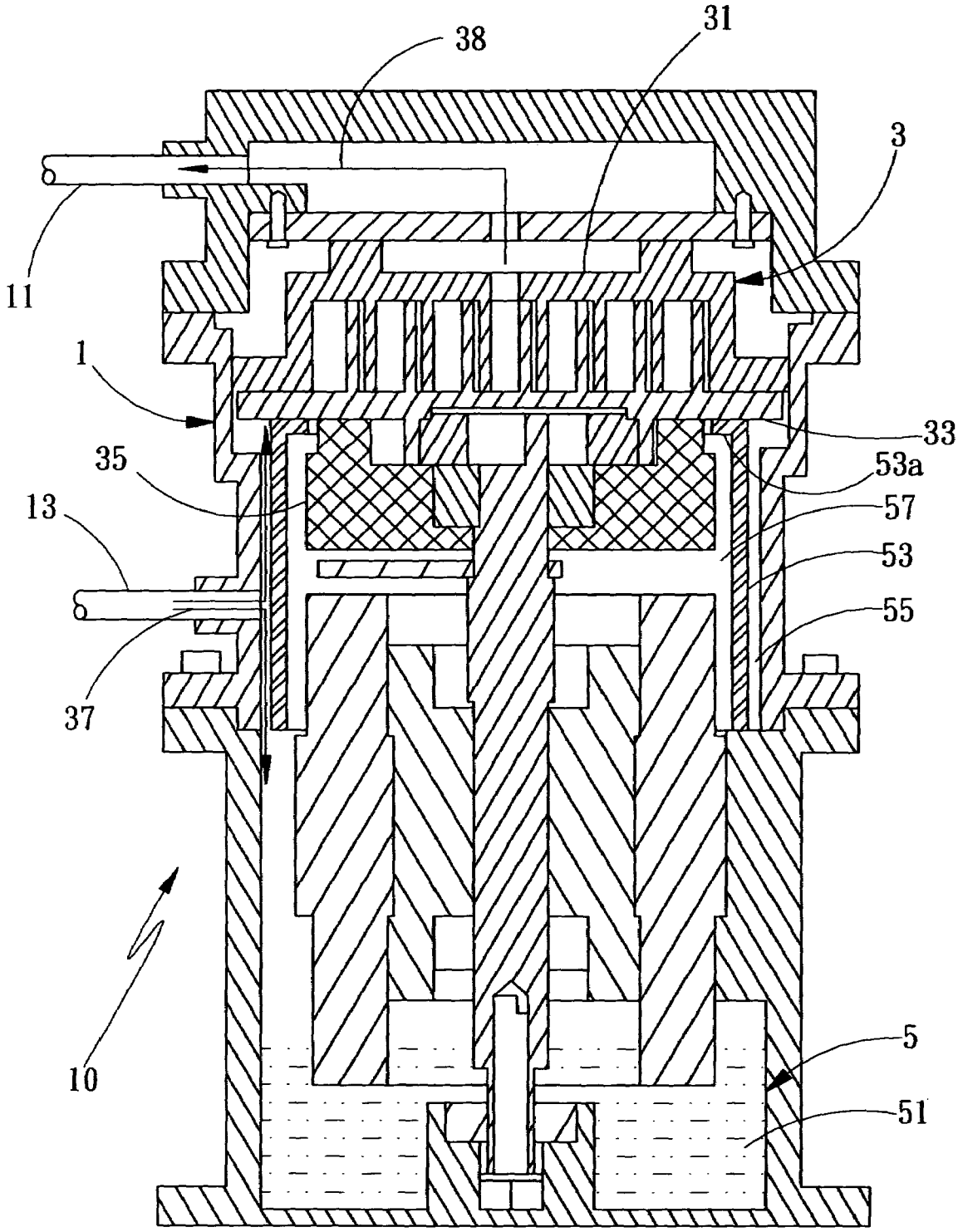
FIG. 3 is a sectional view of the oil recycling apparatus for compressor according to another preferred embodiment of the present invention.

FIG. 3 is a sectional view of the oil recycling apparatus for compressor according to another preferred embodiment of the present invention. The oil baffle plate 53 comprises an annulus top 53*a* inward extended from topside thereof. The annulus top 53*a* will entirely cover the scroll unit 3 such that the oil gas in the scroll unit 3 will not be scattered to the outer passageway 55 from topside of the oil baffle plate 53 and the oil interception area can be increased.

The oil recycling apparatus for compressor according to the present invention has following advantages:

The oil baffle plate provided in the oil recycling apparatus of the present invention will condense the oil gas carried by working gas and recycle the oil gas to the oil tank. The loss of lubricating oil can be prevented.

In the oil recycling apparatus for compressor according to the present invention, the oil baffle plate is around the scroll unit and the scattered oil gas will be condensed to the oil baffle plate instead of contacting the working gas. The condensed oil gas can be recycled to the oil tank and the oil loss due to delivery by the working gas can be prevented.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

What is claimed is:

1. An oil recycling apparatus for a compressor, the compressor comprising a closed casing, a scroll unit for generating a high-pressure working gas and a lubricating unit for providing lubricating oil to other component, the oil recycling apparatus characterized in that:

the lubricating unit comprises an oil tank placed below the scroll unit and used for storing lubricating oil and comprises an oil baffle plate, the oil baffle plate is a panel around the scroll unit, an outer passageway is defined between the casing and the oil baffle plate and communicated with the oil tank;

a high-pressure gas generated by the scroll unit is guided back to the compressor by a reflux tube; and the oil baffle plate extends at least to the reflux tube such that the working gas flowed from the reflux tube directly impinges the oil baffle plate and an oil gas in the working gas is attached to the oil baffle plate, the attached oil gas flows into the oil tank along the oil baffle plate and through the outer passageway due to gravity thereof.

2. The oil recycling apparatus for the compressor as in claim 1, wherein an inner passageway is defined between the oil baffle plate and the scroll unit and communicated with the oil tank; wherein the oil baffle plate extends to a place to which oil gas from the components with relative movement will be scattered, the scattered oil gas is attached to the oil baffle plate, the attached oil gas flows into the oil tank along the oil baffle plate and through the inner passageway due to gravity thereof.

3. The oil recycling apparatus for the compressor as in claim 2, wherein the oil baffle plate comprises an annulus top extended inward from topside thereof and entirely covering the scroll unit such that the oil gas in the scroll unit will not be scattered to the outer passageway from topside of the oil baffle plate.

* * * * *